US007734232B2

(12) United States Patent
Kawai

(10) Patent No.: US 7,734,232 B2
(45) Date of Patent: Jun. 8, 2010

(54) TONER CARTRIDGE

(75) Inventor: Hideaki Kawai, Kyoto (JP)

(73) Assignee: Murata Machinery Ltd., Kyoto (JP)

( * ) Notice: Subject to any disclaimer, the term of this patent is extended or adjusted under 35 U.S.C. 154(b) by 158 days.

(21) Appl. No.: 12/033,962

(22) Filed: Feb. 20, 2008

(65) Prior Publication Data

US 2008/0199227 A1 Aug. 21, 2008

(30) Foreign Application Priority Data

Feb. 21, 2007 (JP) ..... 2007-041465

(51) Int. Cl.
*G03G 15/00* (2006.01)
*G03G 15/08* (2006.01)

(52) U.S. Cl. ..... 399/262; 399/109; 399/120

(58) Field of Classification Search ..... 399/103, 399/106, 109, 110, 111, 114, 119, 120, 260, 399/262, 409; 70/158, 177, 208, 278
See application file for complete search history.

(56) References Cited

U.S. PATENT DOCUMENTS

| | | | | |
|---|---|---|---|---|
| 5,909,610 | A * | 6/1999 | Yoshiki et al. | 399/262 |
| 5,974,286 | A * | 10/1999 | Ban et al. | 399/106 |
| 6,350,026 | B1 * | 2/2002 | Lin | 347/86 |
| 6,496,671 | B2 * | 12/2002 | Nakajima | 399/120 |
| 6,694,782 | B2 * | 2/2004 | Mitsuyama | 70/57.1 |
| 6,778,786 | B2 | 8/2004 | Aritomo et al. | |
| 7,486,905 | B2 * | 2/2009 | Nishimura et al. | 399/106 |
| 2002/0181967 | A1 * | 12/2002 | Sekine | 399/109 |
| 2006/0171737 | A1 * | 8/2006 | Nishimura et al. | 399/109 |
| 2008/0175629 | A1 * | 7/2008 | Eto et al. | 399/262 |

FOREIGN PATENT DOCUMENTS

| | | | |
|---|---|---|---|
| EP | 1 220 050 | A2 | 1/2003 |
| EP | 1 416 333 | A1 | 5/2004 |
| EP | 1 615 084 | A2 | 1/2006 |
| EP | 1 674 944 | A2 | 6/2006 |
| JP | 2006202797 | * | 1/2005 |
| JP | 2006235046 | * | 2/2005 |
| JP | 2006-202797 | A | 8/2006 |
| JP | 2006-235046 | A | 9/2006 |

* cited by examiner

*Primary Examiner*—David M Gray
*Assistant Examiner*—Francis Gray
(74) *Attorney, Agent, or Firm*—Keating & Bennett, LLP

(57) ABSTRACT

In a toner cartridge, a cover member is attached to an outer surface of a case main body so as to cover a filling hole through which a toner is filled in a toner chamber. The cover member is detachably attached to the case main body by a lock mechanism disposed between the case main body and the cover member. The lock mechanism includes two or more lock structures which lock the cover member to the case main body and a release tool which carries out a release operation of the lock structures. Each of the lock structures includes an elastic engagement claw and an engagement recess which are provided on opposite surfaces of the case main body and the cover member, respectively. The release tool is configured to allow all of the elastic engagement claws to be simultaneously displaced in a lock release direction.

5 Claims, 8 Drawing Sheets

TONER CARTRIDGE

BACKGROUND OF THE INVENTION

1. Field of the Invention

The present invention relates to a toner cartridge that is detachably attached to the inside of an electro-photographic type image forming apparatus to supply a toner to a developer unit.

2. Description of Related Art

In the past, in such an electro-photographic type image forming apparatus, a toner replenishment system called a cartridge replacement type in which a toner can be replenished by replacing a toner cartridge has been widely used. In a case of the toner cartridge of the cartridge replacement type, a filling hole through which the toner is filled into a toner chamber is provided, and the filling hole is sealed in an air-tight manner by pressing a cap toward the filling hole after filling the toner therein at the time of shipment from a factory. The toner can be refilled into the toner chamber. In this case, the toner is input therein through the filling hole after the cap is separated therefrom. Subsequently, by attaching the cap thereto, it is possible to keep the filling hole in an air-tight sealed state.

Recently, to further the resource saving movement, a supply product is actively recycled and reused. For this reason, a recyclable product is reused by a so-called recycling manufacturer other than an original manufacturer. That is, the recycling manufacturer collects the toner cartridge, refills the toner into the collected toner cartridge, and then supplies the refilled toner cartridge in the form of a low-cost recycled product to a user.

However, when the toner different from a genuine toner is refilled by the recycling manufacturer, image quality formed by an image forming apparatus may easily deteriorate. A genuine toner which is carefully made by the manufacturer should be used in accordance with characteristics of the image forming apparatus as the toner used in such an image forming apparatus. When a non-genuine toner is refilled, a performance of the image forming apparatus is not sufficiently exhibited, which eventually deteriorates image quality.

JP-A-2002-258595 discloses a method of preventing non-genuine toner from being used. In such a method disclosed in JP-A-2002-258595, the toner cartridge includes a toner bottle in which the toner is contained, a bottle case to which the toner bottle is attached, a case cover which covers an opening portion of the toner bottle case, and a lock member which locks the case cover to the toner bottle case. The lock member is configured so as not to be reused (relocked) when the case cover is separated from the case cover. That is, when a new lock member is not provided, it is not possible to attach again the case cover to the toner bottle case.

Accordingly, in order to recycle the toner cartridge, it is necessary to prepare a spare lock member, and thus it is difficult to manufacture a toner cartridge of a recyclable product in which the non-genuine toner is refilled.

In the method disclosed in JP-A-2002-258595, a problem arises in that an attachment/detachment operation of the lock member is difficult and even when the genuine toner is refilled by a manufacturer or a regular distributor, etc. (hereinafter, referred to as a manufacturer, etc.), the attachment/detachment operation of the lock member is troublesome. As a result, work efficiency may easily deteriorate. That is, when the toner cartridge of the recycled product is manufactured by a manufacturer, etc., the toner cartridge is disassembled and the lock member is separated therefrom. Subsequently, a toner refill operation is carried out, the lock member is replaced, and then the toner cartridge is assembled again. Accordingly, it is difficult and troublesome to carry out a series of operations.

Additionally, since the spare lock member needs to be prepared, it is disadvantageous in that a cost of the toner cartridge of the recycle product necessarily increases.

SUMMARY OF THE INVENTION

In order to overcome the problems described above, preferred embodiments of the present invention prevent the non-genuine toner from being refilled in the toner cartridge for the image forming apparatus and to efficiently carry out a refill operation of the genuine toner by a manufacturer, etc.

According to a preferred embodiment of the present invention, a toner cartridge includes a toner chamber which is provided in a case main body to contain a toner; a filling hole which is provided in an outer surface of the case main body to fill the toner into the toner chamber; and a cover member which is attached to the outer surface of the case main body to cover the filling hole. The cover member is detachably attached to the case main body by a lock mechanism located between the case main body and the cover member. The lock mechanism has two or more lock structures which lock the cover member to the case main body and a release tool which carries out a lock release operation of the lock structures. Each of the lock structures has an elastic engagement claw and an engagement recess which are provided on opposite surfaces of the case main body and the cover member, respectively. The release tool allows all of the elastic engagement claws to be simultaneously displaced in a lock release direction.

According to another preferred embodiment of the present invention, a concave space which is divided from the inside of the case main body and which opens outwardly may be provided on a side surface of the case main body, and the cover member may be attached thereto to seal the opening of the concave space. Each of the lock structures may be attached to the inside of the concave space. A release operation hole which allows the release tool to be inserted into the concave space may be provided in the case main body and/or the cover member facing the concave space.

According to a further preferred embodiment of the present invention, an operation surface corresponding to each of the lock structures may be provided in the release tool. When the release tool is inserted into the concave space, the operation surfaces may allow all of the elastic engagement claws to be simultaneously displaced in the lock release direction, so that a lock state between the cover member and the case main body is released.

According to an additional preferred embodiment of the present invention, the lock mechanism may have a pair of lock structures which are disposed adjacent to each other. A direction where an opposed gap between the elastic engagement claws serving as each of the lock structures becomes close may be set to the lock release direction. One or two operation grooves may be provided in the release tool. When the release tool is inserted into the concave space through the release operation hole, operation surfaces of the operation grooves may allow the elastic engagement claws of both the lock structures to be simultaneously displaced in the lock release direction, so that a lock state between the cover member and the case main body is released.

According to a further preferred embodiment of the present invention, the release operation hole may be provided in the upper surface of the case main body and/or the cover member facing the concave space. The lock mechanism may have a plurality of lock rows having a pair of left and right lock structures which are disposed adjacent to each other. A direction where an opposed gap between the elastic engagement claws serving as the lock structures in each of the lock rows becomes close may be set to the lock release direction. The lock rows may be disposed in a vertical multi-stage shape and is configured such that a dimension of an opposed gap of the lock structures in each of the lock rows becomes closer toward the lower stage. One operation groove may be provided in the release tool and a plurality of operation surfaces corresponding to the lock structures in each of the lock rows may be provided in the operation groove. When the release tool is inserted into the concave space through the release operation hole, the operation surface may allow the elastic engagement claws of the lock structures serving as all of the lock rows to be simultaneously displaced in the lock release direction, so that a lock state between the cover member and the case main body is released.

According to a preferred embodiment of the present invention, since the cover member is disposed so as to cover the filling hole of the toner in the case main body, and the lock structure is provided between the case main body and the cover member so as not to allow the cover member to be separated therefrom, the cover member can be securely attached to the case main body in a normal usage. Accordingly, it is possible to prevent a foreign substance from being introduced into the filling hole.

Since two or more lock structures are provided, it is possible to efficiently prevent the lock release operation of all the lock structures from being carelessly or easily carried out. Accordingly, it is possible to prevent the cover member from being illegally separated by a recycling manufacture, and thus it is possible to securely prevent a recycled toner cartridge in which a non-genuine toner is refilled from being manufactured. Thus, it is possible to prevent a case where a user of the image forming apparatus to which the toner cartridge is applied purchases a low-quality toner cartridge by mistake. Since two or more lock structures are provided, it is possible to prevent the cover member from being carelessly separated therefrom due to a drop shock, etc.

Above all, since the release tool can simultaneously allow all of the elastic engagement claws to be displaced in the lock release direction, it is possible to simply and securely to carry out the lock release operation using the release tool in a one-touch manner so that the cover member is separated from the case main body. Additionally, it is possible to attach the cover member just by a simple operation in which the elastic engagement claws is positioned to the engagement recesses, the cover member is pressed toward the case main body, and then an engagement state between the elastic engagement claws and the engagement recesses is secured. Accordingly, it is possible to carry out the toner refill operation in the same procedure as that of the known toner refill operation except for the lock release operation using the release tool, and thus it is possible to promptly and efficiently carry out a series of toner refill operations.

According to another preferred embodiment of the present invention, since the lock release operation can be carried out through the release operation hole, and the dimension of the opening of the release operation hole is set so that a person's finger cannot not be inserted therein, it is possible to prevent a case where the lock state of the lock structures is released by a person who does not have the release tool. Accordingly, it is possible to more securely prevent the cover member from being separated therefrom.

According to a further preferred embodiment of the present invention, since operation surfaces corresponding to all of the lock structures are provided in one release tool, it is possible to carry out the lock release operation of the lock structures in a one-touch manner just by a simple operation in which the release tool is inserted into the release operation hole. That is, it is possible to simply and securely separate the cover member from the case main body compared with a case in which a plurality of release tools are necessary.

According to another preferred embodiment of the present invention, since a direction where an opposed gap between both the elastic engagement claws serving as the lock structures becomes close is set to the lock release direction, it is possible to carry out the lock release operation of the lock structure in a one-touch manner just by a simple operation in which the both the elastic engagement claws are deformed inwardly by the operation groove of the release tool.

According to a further preferred embodiment of the present invention, since a plurality of lock rows are arranged in a vertical multi-stage shape, it is possible to securely attach the cover member to the case main body while keeping the operability of the lock mechanism as the number of the lock structures increases. Additionally, as the number of the lock structures increases, the number of the operation surfaces increases. Accordingly, it is possible to securely prevent a case where a person who does not have the release tool illegally copies the release tool.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

First Preferred Embodiment

Figure 1:
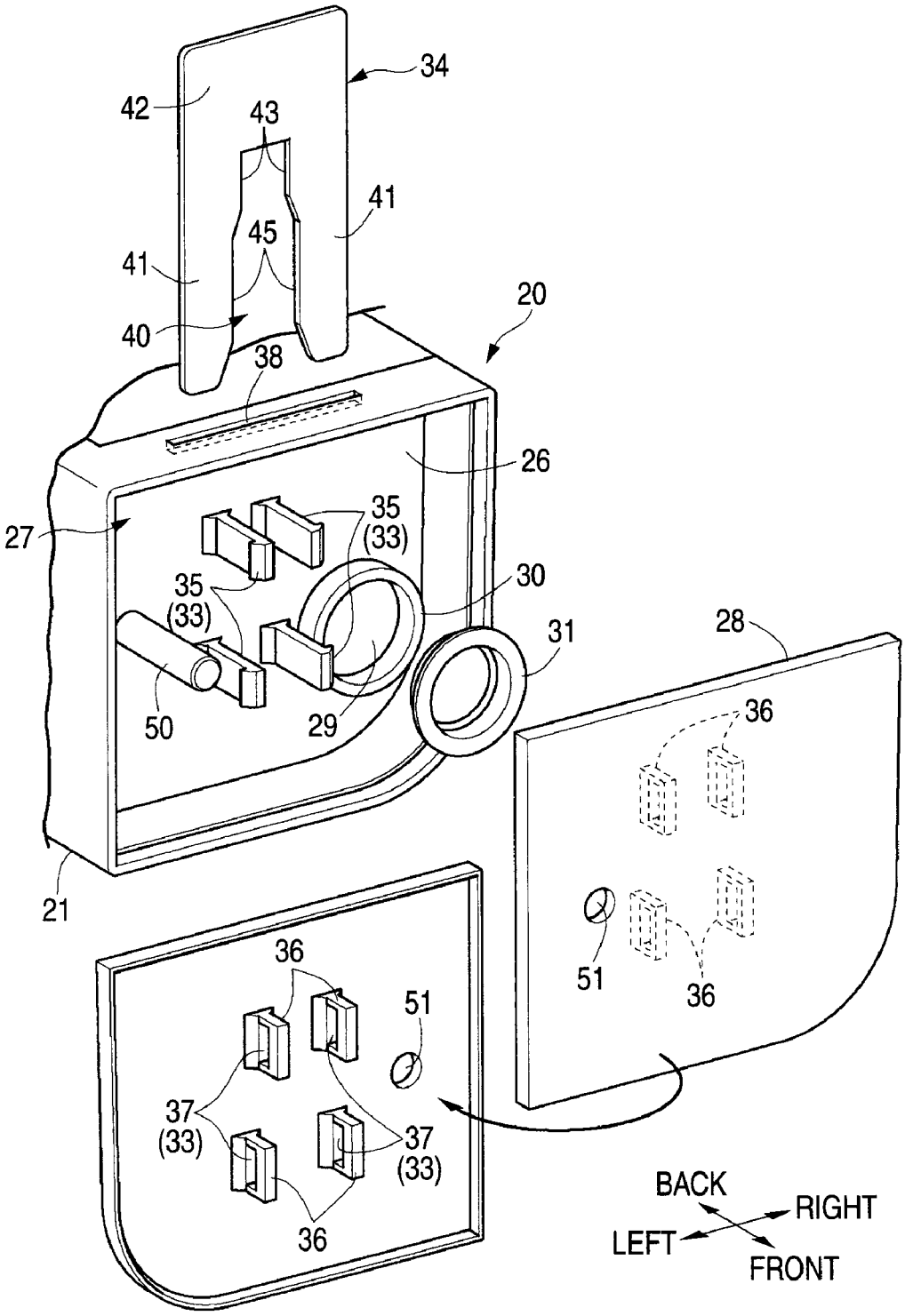
FIG. 1 is an exploded perspective view illustrating a main portion of a toner cartridge according to a first preferred embodiment of the present invention.
Figure 2:
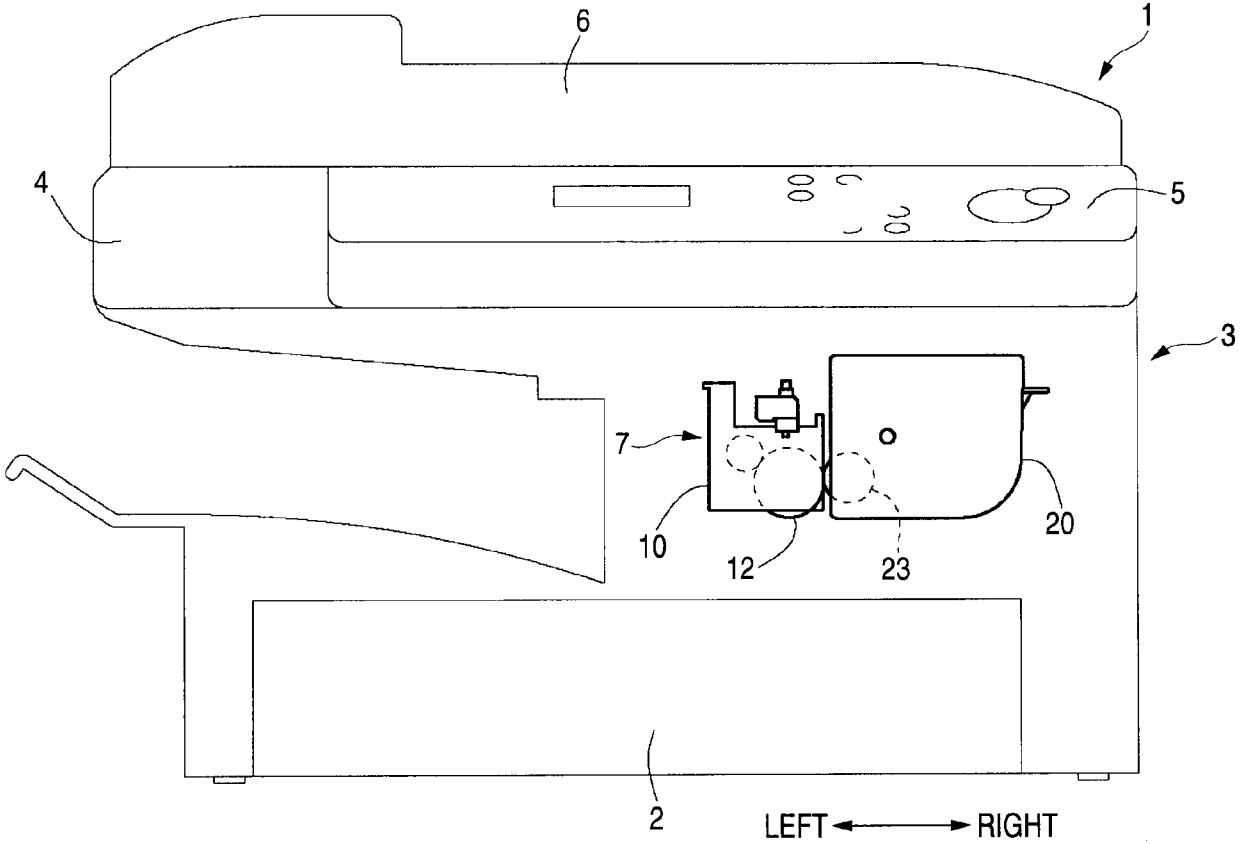
FIG. 2 is a view illustrating an image forming apparatus to which the toner cartridge according to a preferred embodiment of the present invention is applied.

FIGS. 1 to 6 show a first preferred embodiment in which a toner cartridge according to the present invention is used as that of a multi-function machine preferably including a copy function and a facsimile function. In FIG. 2, the multi-function machine (image forming apparatus) 1 includes a sheet feeding cassette 2, an image printing unit 3 which performs an image printing operation on a print sheet fed from the sheet feeding cassette 2 through a sheet feeding passage, and an image readout unit 4 which is disposed above the image printing part 3. On the upper surface of the image readout unit 4, an operation panel 5 with various operation buttons and an automatic document feeder (ADF) 6 are provided.

In the present preferred embodiment, for the convenience of description, an extension direction of the operation panel 5 is referred to as a left/right direction (see FIG. 2). Additionally, a direction which is horizontally perpendicular to the left/right direction is referred to as a frontward/backward direction (see FIG. 1).

Figure 3:
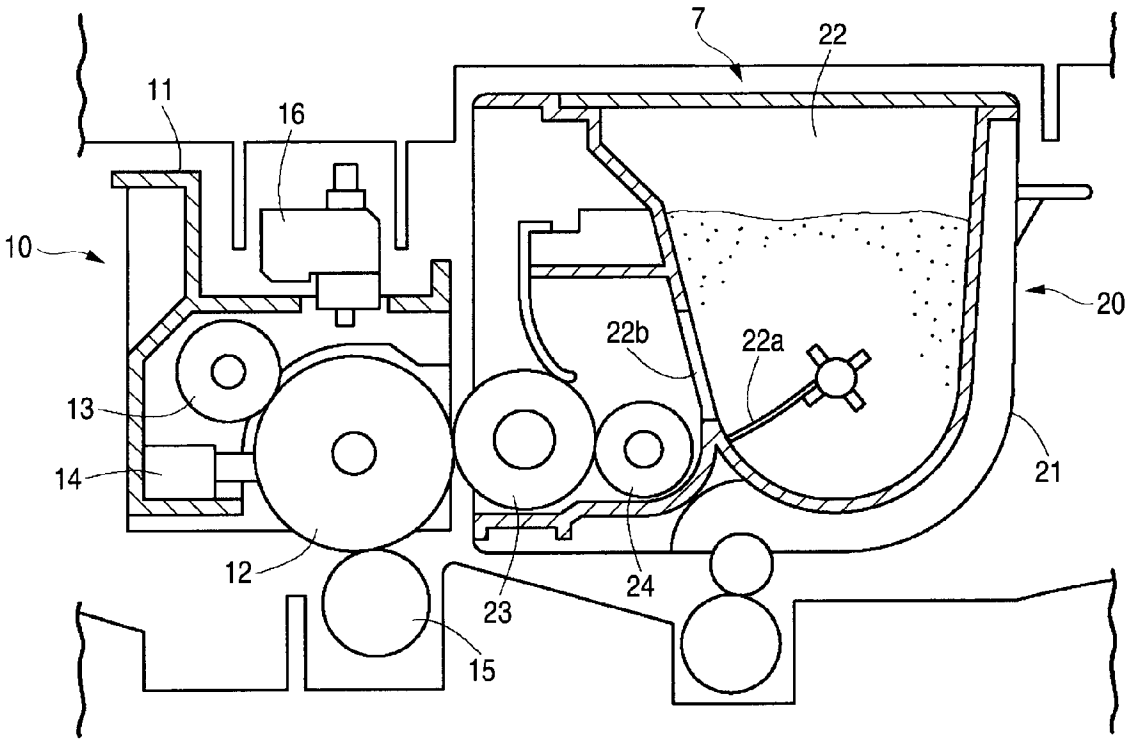
FIG. 3 is a configuration diagram illustrating a vertical sectional configuration of a process unit having the toner cartridge and a photosensitive unit.

In FIGS. 2 and 3, a process unit 7 which performs an image forming operation on the print sheet includes a photosensitive unit 10 and a toner cartridge 20 for supplying a toner to the photosensitive unit 10. As shown in FIG. 3, the photosensitive unit (hereinafter, simply referred to as a unit) 10 includes a photosensitive drum (photosensitive) 12 which comes into contact with the print sheet to transfer the toner thereto, a charger 13 which charges the surface of the photosensitive drum 12 to have a certain electrical potential, and an electricity removing brush 14, in an angled box-like case main body 11 of which a transverse dimension is long in the frontward/backward direction. A transfer roller 15 is disposed opposite the photosensitive drum 12 and an LED head 16 forms an electrostatic latent image on the photosensitive drum 12.

The toner cartridge (hereinafter, simply referred to as a cartridge) 20 includes a toner chamber 22 which contains the toner, a developer roller 23 which supplies the toner to the photosensitive drum 12, and a supply roller 24 which supplies the toner contained in the toner chamber 22 to the developer roller 23, in an angled box-like case main body 21 of which a transverse dimension is long in the frontward/backward direction. While the toner in the toner chamber 22 is agitated by an agitator 22*a* which is attached to the inside of the toner chamber 22, the toner is supplied from an opening portion 22*b* provided on the left surface of the toner chamber 22 to the photosensitive drum 12 through the supply roller 24 and the developer roller 23. Accordingly, the toner is attached to the electrostatic latent image formed on the photosensitive drum 12, and then the toner image is formed thereon. Subsequently, the toner image is sequentially transferred to the sheet which is fed from the sheet feeding cassette 2 to the image printing unit 3.

The unit 10 and the cartridge 20 serving as the process unit 7 are detachably attached to a unit attachment portion and a cartridge attachment portion which are formed in the image printing unit 3. In such an attachment state, when the developer roller 23 is closely pressed to the photosensitive drum 12, the toner is supplied from the cartridge 20 to the photosensitive drum 12.

Figure 4:
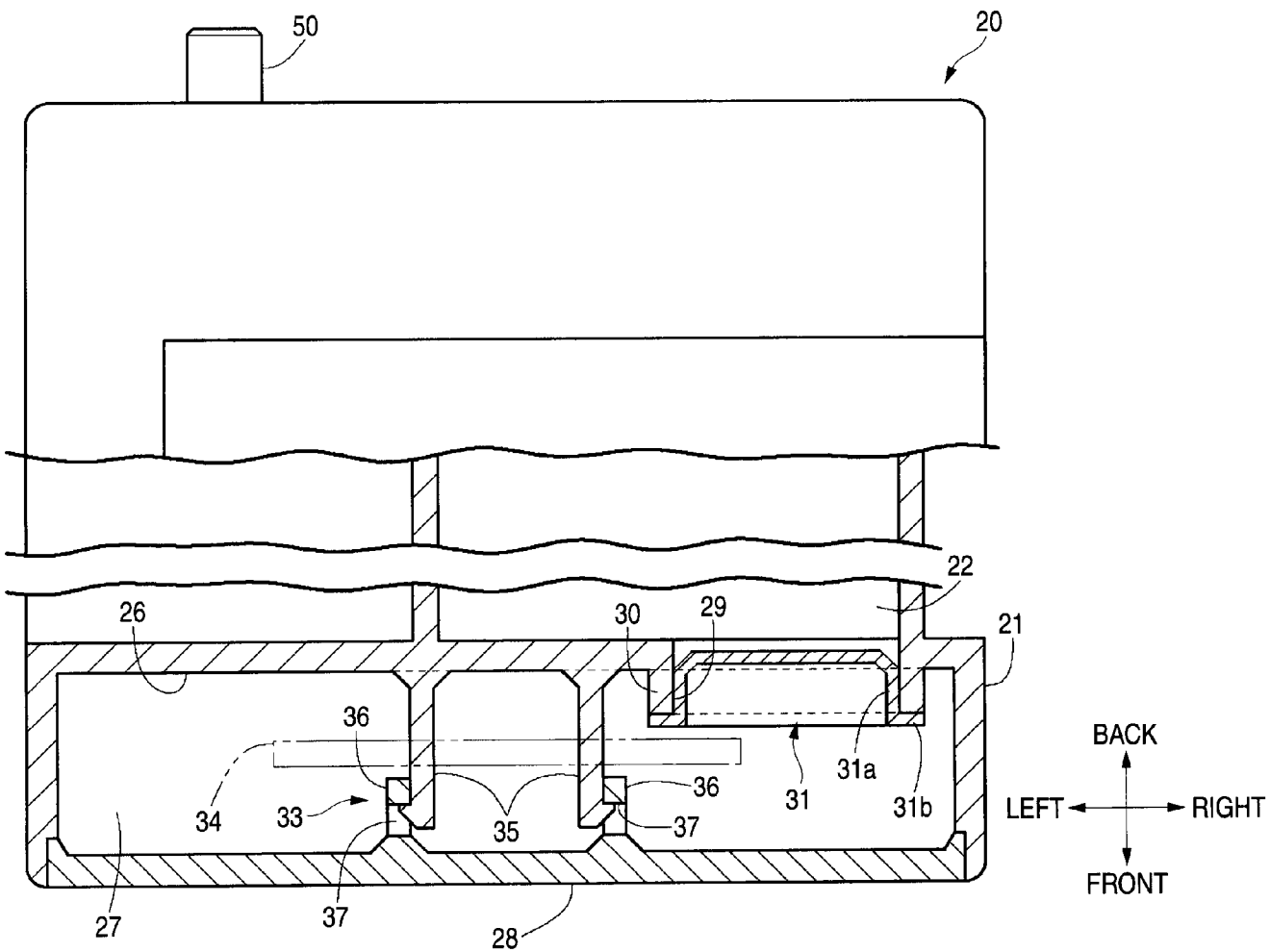
FIG. 4 is a sectional view taken along the line A-A shown in FIG. 5.

As shown in FIGS. 1 and 4, on the front surface of the case main body 21 of the cartridge 20, a concave space 27 which is partitioned from the inside of the case main body 21 by a partition wall 26 so as to open in a frontward direction is formed, and a cover member 28 is attached so as to seal the opening of the concave space 27. In a position adjacent to a portion right below the partition wall 26, a filling hole 29 through which the toner is filled into the toner chamber 22 is provided. The filling hole 29 preferably has a substantially circular shape, and an opening wall 30 with a substantially cylindrical shape is provided in the periphery of the filling hole 29 on the side of the concave space 27 so as to protrude in the frontward direction. As seen in FIG. 1, an engagement protrusion 50 which positions the cartridge 20 so as not to move at the time the cartridge 20 is attached to the cartridge attachment portion of the image printing unit 3, and an insertion through hole 51 is provided in the cover member 28 to insert the engagement protrusion 50 therethrough.

A cap 31 which air-tightly seals the filling hole 29, as shown in FIG. 4, preferably is a resin molded product in which a main body portion 31*a* with a substantially cylindrical shape and a toric flange portion 31*b* which protrudes outward from one end of the main body portion 31*a* are integrally formed with each other. When the main body portion 31*a* is pushed into the filling hole 29, the main body portion 31*a* is fitted into the opening wall 30 so as to air-tightly seal the filling hole 29. In such an air-tightly sealed state, since the flange portion 31*b* is received on a protrusion end of the opening wall 30, it is possible to restrict an insertion limit of the cap 31 with respect to the filling hole 29. Additionally, when the flange portion 31*b* is pulled frontward using a finger, etc. so as to separate the cap 31 therefrom, it is possible to release the air-tightly sealed state of the filling hole 29. When the air-tightly sealed state is released in this way, it is possible to supply the toner to the toner chamber 22 through the filling hole 29.

The cover member 28 is detachably attached to the case main body 21 by the use of a lock mechanism which is located between the case main body 21 and the cover member 28. That is, the cover member 28 seals the opening of the concave space 27 at a normal time so as to prevent the cap 31 from separating therefrom by mistake or mischief. Also, at the time of filling the toner, the cover member 28 and the cap 31 are sequentially separated so as to fill the toner into the toner chamber 22 through the filling hole 29. A dimension in the up/down direction and a dimension in the left/right direction of the cover member 28 are set to be slightly smaller than that of the opening portion of the concave space 27.

Figure 5:
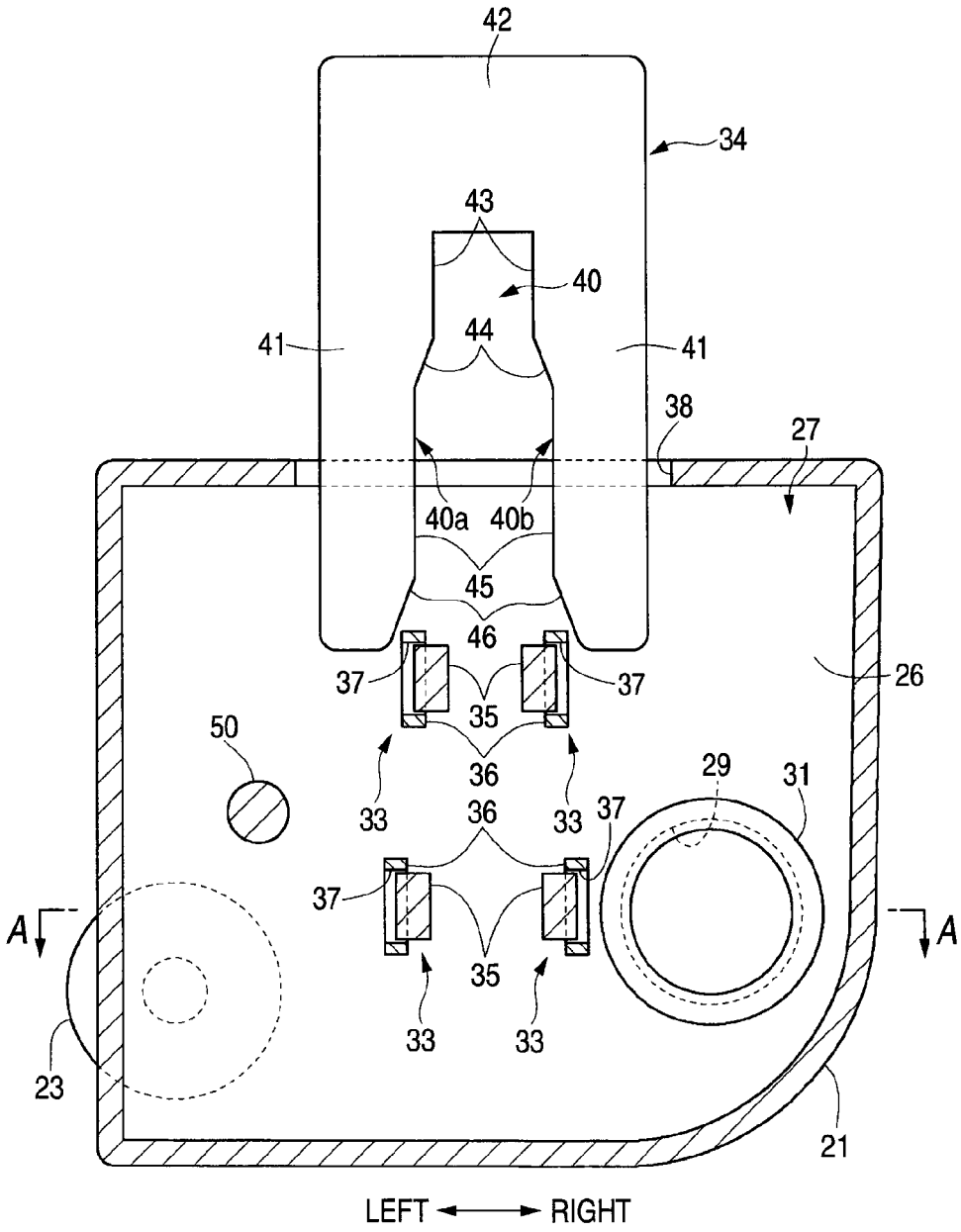
FIG. 5 is a view illustrating a process of a lock release operation of a lock mechanism of the toner cartridge.
Figure 6:
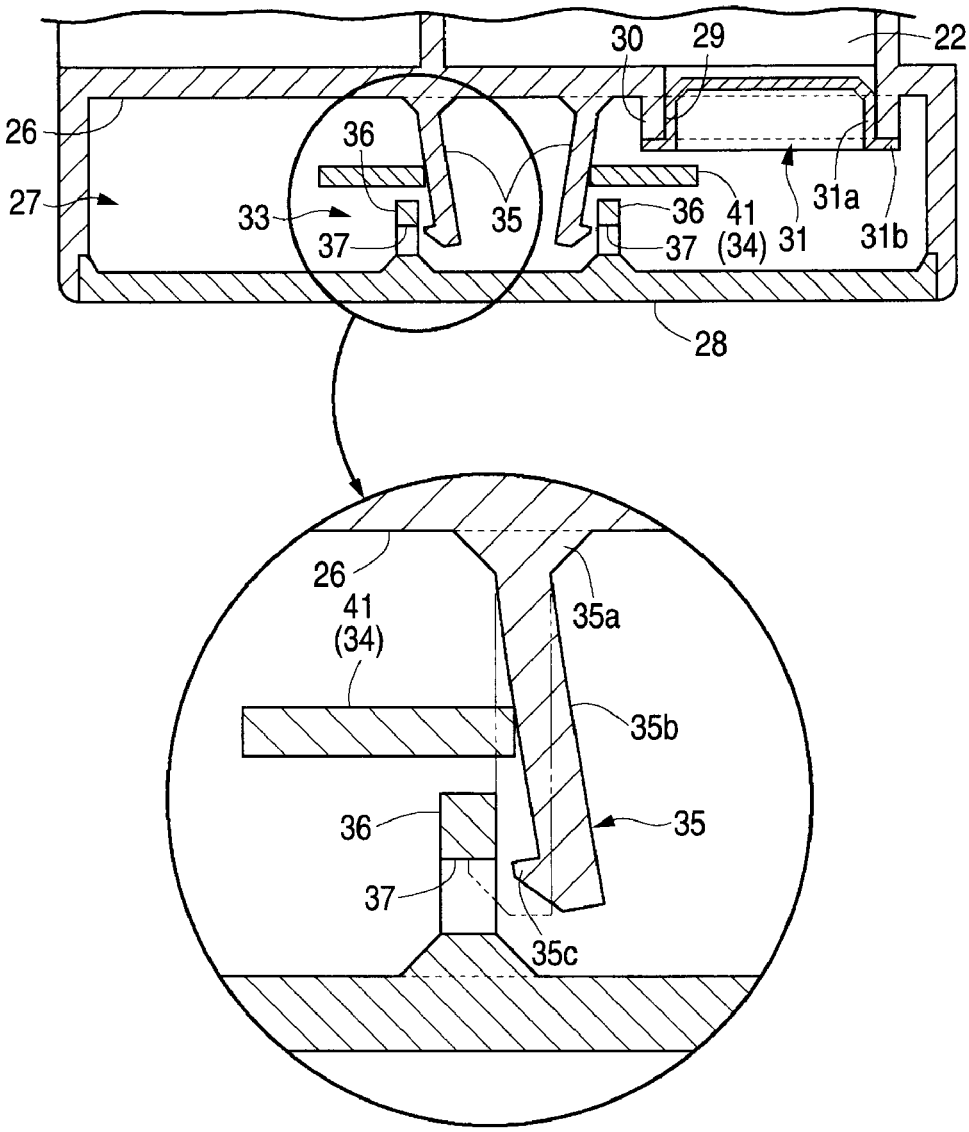
FIG. 6 is a view illustrating a state where a lock state of a lock structure in the lock mechanism of the toner cartridge is released.

The lock mechanism includes two or more lock structures 33 which lock the cover member 28 to the case main body 21 and a release tool 34 which carries out a lock releases operation of the lock structures 33. The lock mechanism according to the present preferred embodiment, as shown in FIGS. 1 and 5, preferably includes two sets of lock rows having a pair of left and right lock structures 33 which are disposed adjacent to each other. As shown in FIGS. 4 and 6, each of the lock structures 33 includes an elastic engagement claw 35 which protrudes from the partition wall 26 of the case main body 21 and an engagement hole (engagement recess) 37 which is formed on a receiving tool 36 protruding from the rear surface of the cover member 28.

As shown in FIG. 6, each of the elastic engagement claws 35 includes a thick base end portion 35*a* which is formed on the same plane of the partition wall 26, an operated portion 35*b* which extends from the base end portion 35*a* so as to be elastically deformable, and an engagement portion 35*c* which is formed on the protruding end of the operated portion 35*b*. A direction where an opposed gap between the elastic engagement claws 35 respectively serving as the lock structure 33 in each lock row comes closer is referred to as a lock release direction. That is, as for the lock structure 33 on the left side, as shown in FIG. 6, when the operated portion 35*b* of the elastic engagement claw 35 in a locked state (a state which is depicted by an imaginary line) is displaced to the right side, it becomes a lock release state (a state which is depicted by a solid line) where an engagement between the engagement hole 37 and the engagement portion 35*c* is released. As for the lock structure 33 on the right side, the same applies when the left/right direction is reversed. The two sets of lock rows are disposed in a form of two vertical stages, as shown in FIG. 5, and are configured such that a dimension of an opposed gap between the lock structures 33 in the lock rows becomes larger toward the lower stage.

As described above, since each of the lock structures 33 is attached to the inside of the concave space 27, it is not possible to touch each of the lock structures 33 with a hand or finger at a normal time the opening of the concave space 27 is sealed by the cover member 28. As means for releasing the lock state of each of the lock structures 33 in this case, the lock mechanism according to the present preferred embodiment includes the release tool 34. When the release tool 34 is inserted into the concave space 27 through a release operation hole 38 with a slit shape which is long in the left/right direction and which is provided on the upper surface of the case main body 21 toward the concave space 27, it is possible to carry out the lock release operation of the lock structures 33. In order to prevent a case where the lock state of each of the lock structures 33 is released by a person who does not have the release tool 34, the dimension of the opening of the release operation hole 38 is set so that a person's finger cannot be inserted therein.

The release tool 34, as shown in FIGS. 1 and 5, is a plate-like resin molded product with an inverted ∪ shape in which one operation groove 40 is formed on the lower portion, and includes a pair of left and right leg portions 41 and a connection portion 42 connecting both leg portions 41. Each of left and right opposite surfaces 40*a* and 40*b* which partitions the operation groove 40 and the left and right leg portions 41 includes an operation surface 43, a guide surface 44, an operation surface 45, and a guide surface 46. The operation surface 43 extends in the up/down direction. The guide surface 44 with a taper shape is continued on the plane of the lower end of the operation surface 43 to widen out in a downward direction. The operation surface 45 is continued on the plane of the lower end of the guide surface 44 to extend in the up/down direction. The guide surface 46 with a taper shape is continued on the plane of the lower end of the operation surface 45 to get widen downwardly. The operation surface 43, the guide surface 44, the operation surface 45, and the guide surface 46 are provided sequentially from the upside. The operation surfaces 43 and the operation surfaces 45 correspond to the lock structures 33 in the lock row of the upper stage and the lock structures 33 in the lock row of the lower stage, respectively.

When the release tool 34 is inserted into the concave space 27 through the release operation hole 38 and the release tool 34 is moved downwardly, the elastic engagement claws 35 in the lock row of the upper stage are guided to the opposite space of the operation surfaces 43 by the upside guide surfaces 44. At the almost same time, the elastic engagement claws 35 in the lock row of the lower stage are guided to the opposite space of the operation surfaces 45 by the downside guide surfaces 46. Accordingly, all of the elastic engagement claws 35 are deformed so as to be bent inwardly, and thus the lock state of all of the lock structures 33 is released at the same time. As a result, it is possible to separate the cover member 28 from the case main body 21.

In the toner cartridge according to the embodiment as described above, since the cover member 28 is disposed so as to cover the filling hole 29, through which the toner is filled, of the case main body 21, and the lock structure 33 which locks the cover member 28 so as not to be separated therefrom is disposed between the case main body 21 and the cover member 28, the cover member 28 can be securely locked to the case main body 21 by the lock structure 33 during a normal usage. Accordingly, it is possible to prevent that a foreign substance from being introduced via the filling hole 29.

Additionally, since the lock mechanism includes two or more lock structures 33, it is possible to efficiently prevent the lock release operation of all the lock structures 33 from being carelessly carried out. Also, it is possible to prevent the cover member 28 from carelessly coming off due to a drop shock, etc.

Since the lock release operation is simply and securely carried out by the release tool 34 in a one-touch manner, it is possible to separate the cover member 28 from the case main body 21. Further, it is possible to attach the cover member 28 just by a simple operation in which the elastic engagement claw 35 is positioned to the engagement recess 37, the cover member 28 is pressed toward the case main body 21, and then an engagement state between the elastic engagement claw 35 and the engagement recess 37 is secured. Accordingly, it is possible to carry out the toner refill operation in the same procedure as that of the known toner refill operation except for the lock release operation using the release tool 34, and thus it is possible to promptly and efficiently carry out a series of toner refill operations.

Since the dimension of the opening of the release operation hole 38 is set so that a person's finger cannot be inserted therein, it is possible to prevent a case where the lock state of each of the lock structures 33 is released by a person who does not have the release tool 34. Accordingly, it is possible to more securely prevent the cover member 28 from being separated therefrom.

Second Preferred Embodiment

Figure 7:
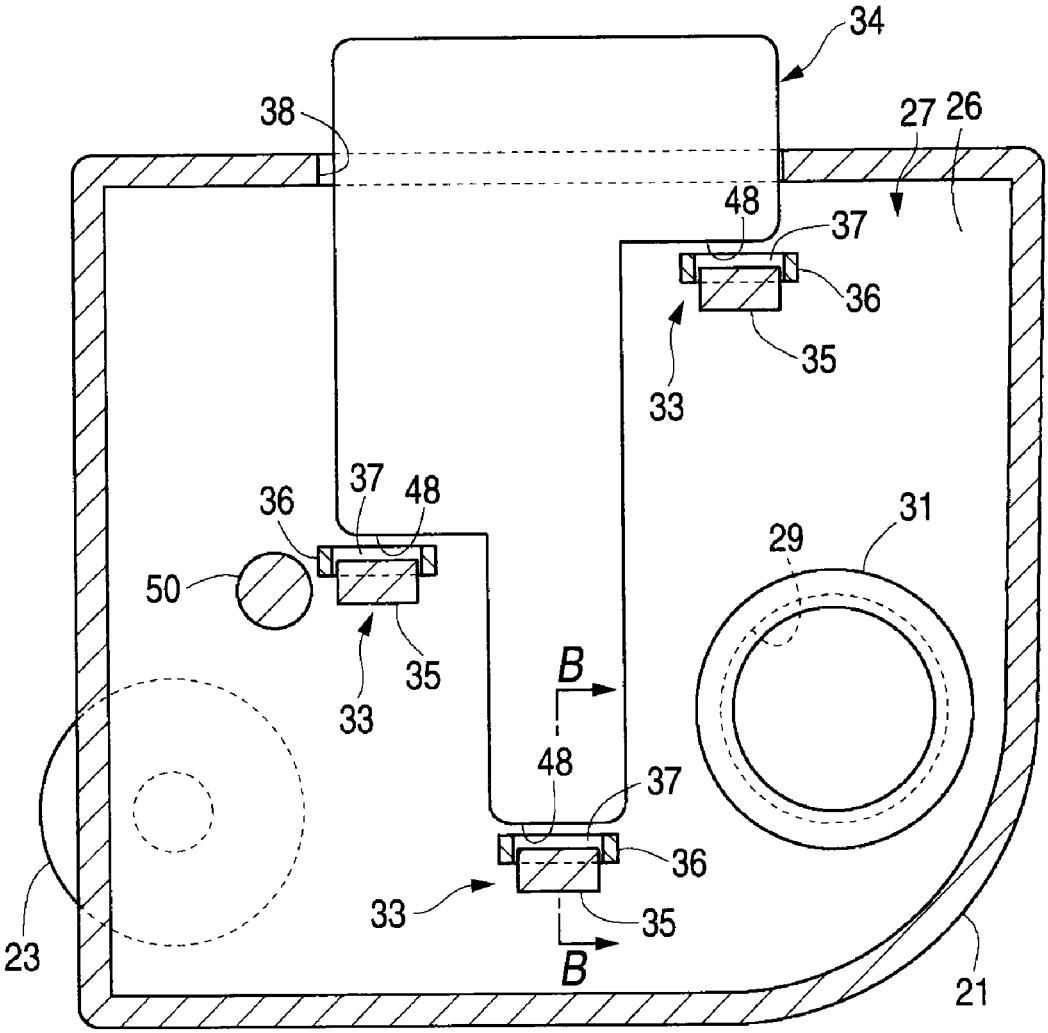
FIG. 7 is a view illustrating a process of a lock release operation of a lock mechanism of the toner cartridge according to a second preferred embodiment of the invention.
Figure 8:
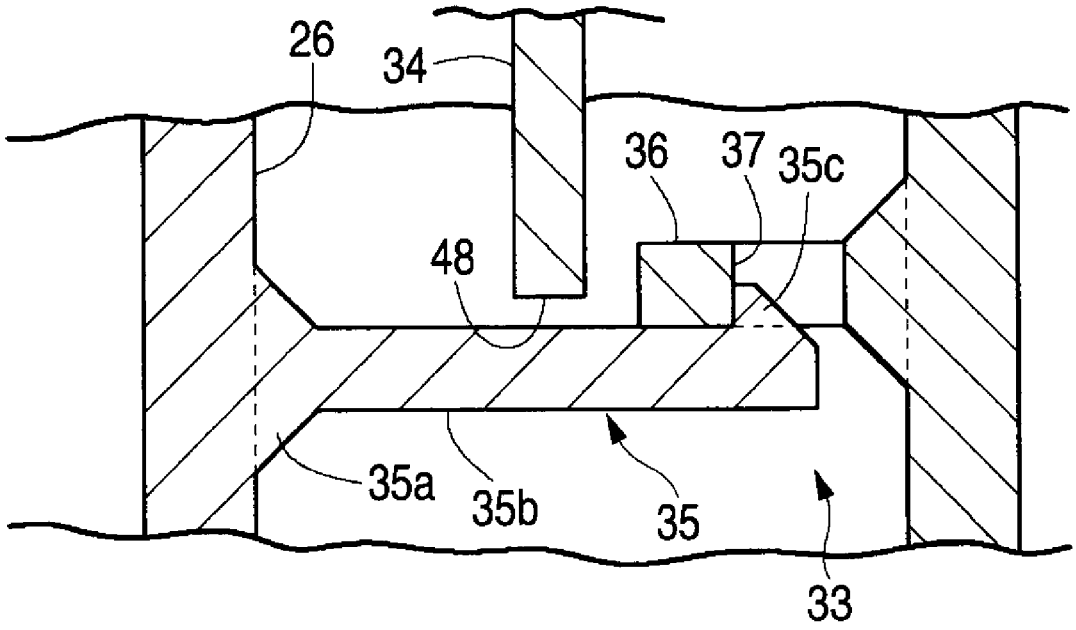
FIG. 8 is a sectional view taken along the line B-B shown in FIG. 7.

The toner cartridge according to a second preferred embodiment of the invention will be described with reference to FIGS. 7 and 8. As the lock mechanism according to the present preferred embodiment, three lock structures 33 are preferably disposed at different positions from the release operation hole 38. The downward direction of each of the elastic engagement claws 35 serving as each of the lock structures 33 is set to a lock release direction. Accordingly, the release tool 34 does not include a portion corresponding to the operation groove 40 according to the first preferred embodiment, but includes a horizontal operation surface 48 which extends in the left/right direction so as to correspond to each of the lock structures 33. Since the other configurations are preferably the same as those of the first preferred embodiment, the same reference numerals are given to the same components and the description thereof will be omitted. Additionally, in the second preferred embodiment, the same effects and advantages as those of the first preferred embodiment can be obtained.

In the preferred embodiments described above, the release operation hole 38 is preferably provided on the upper surface of the case main body 21, but may be provided in the cover member 28 or may be provided in both of them 21 and 28. In the first preferred embodiment, the lock mechanism preferably may have one set or three sets or more of lock rows.

While the present invention has been described with respect to preferred embodiments thereof, it will be apparent to those skilled in the art that the disclosed invention may be modified in numerous ways and may assume many embodiments other than those specifically set out and described above. Accordingly, it is intended that the appended claims cover all modifications of the present invention that fall within the true spirit and scope of the present invention.

What is claimed is:

1. A toner cartridge comprising:

a case main body including a toner chamber which contains a toner, an outer surface of the case main body having a filling hole for filling the toner into the toner chamber;

a cover member attached to the outer surface of the case main body to cover the filling hole; and a lock mechanism; wherein the cover member is detachably attached to the case main body by the lock mechanism provided between the case main body and the cover member;

the lock mechanism includes at least two lock structures which lock the cover member to the case main body and a release tool that has a structure that is adapted to perform a lock release operation of the at least lock structures;

each of the at least two lock structures has an elastic engagement claw and an engagement recess which are provided on opposite surfaces of the case main body and the cover member, respectively; and the release tool has a structure that allows all of the elastic engagement claws to be simultaneously displaced in a lock release direction.

2. The toner cartridge according to claim 1, wherein the case main body has on a side surface thereof a concave space divided from the inside of the case main body, the concave space opening outwardly, the cover member is attached to the side surface of the case main body to seal the opening of the concave space, each of the at least two lock structures is attached to the inside of the concave space, and a release operation hole which allows the release tool to be inserted into the concave space is provided in at least one of the case main body and the cover member which face the concave space.

3. The toner cartridge according to claim 2, wherein an operation surface corresponding to each of the at least two lock structures is provided in the release tool, and when the release tool is inserted into the concave space, the operation surface allows all of the elastic engagement claws to be simultaneously displaced in the lock release direction, so that a lock state between the cover member and the case main body is released.

4. The toner cartridge according to claim 2, wherein the lock mechanism has a pair of lock structures which are disposed adjacent to each other, a direction where an opposed gap between the elastic engagement claws serving as the lock structures becomes close is set to the lock release direction, at least one operation groove is provided in the release tool, and when the release tool is inserted into the concave space through the release operation hole, operation surfaces of the operation grooves allow the elastic engagement claws of both the lock structures to be simultaneously displaced in the lock release direction, so that a lock state between the cover member and the case main body is released.

5. The toner cartridge according to claim 2, wherein the release operation hole is provided in the upper surface of at least one of the case main body and the cover member which face the concave space, the lock mechanism has a plurality of lock rows having a pair of left and right lock structures which are disposed adjacent to each other, a direction where an opposed gap between the elastic engagement claws serving as the lock structures in each of the lock rows becomes close is set to the lock release direction, the lock rows are disposed in a vertical multi-stage shape and are configured such that a dimension of an opposed gap of the lock structures in each of the lock rows becomes larger toward the lower stage, at least one operation groove is provided in the release tool and a plurality of operation surfaces corresponding to the lock structures in each of the lock rows are provided in the operation groove, and when the release tool is inserted into the concave space through the release operation hole, the operation surface allows the elastic engagement claws of the lock structures serving as the lock rows to be simultaneously displaced in the lock release direction, so that a lock state between the cover member and the case main body is released.

* * * * *